US010315670B2

(12) United States Patent
Sanchez et al.

(10) Patent No.: US 10,315,670 B2
(45) Date of Patent: Jun. 11, 2019

(54) BOGIE FOR FULL DOUBLE DECK EMU

(71) Applicant: ALSTOM TRANSPORT TECHNOLOGIES, Saint-Ouen (FR)

(72) Inventors: Carlos Sanchez, Paris (FR); Alain Rodet, Chalon sur Saone (FR); Jose Julio Muyo, Paris (FR); Emmanuel Lafoix, Courbevoie (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 235 days.

(21) Appl. No.: 15/332,111

(22) Filed: Oct. 24, 2016

(65) Prior Publication Data

US 2017/0113705 A1 Apr. 27, 2017

(30) Foreign Application Priority Data

Oct. 23, 2015 (FR) ..... 15 60142

(51) Int. Cl.

| | |
|---|---|
| ***B61F 3/12*** | (2006.01) |
| ***B61D 1/06*** | (2006.01) |
| ***B61F 5/50*** | (2006.01) |

(52) U.S. Cl.

CPC ..... *B61F 3/125* (2013.01); *B61D 1/06* (2013.01); *B61F 5/50* (2013.01)

(58) Field of Classification Search

CPC ..... B61F 3/00; B61F 3/02; B61F 3/04; B61F 3/08; B61F 3/12; B61F 3/125; B61F 3/16

See application file for complete search history.

(56) References Cited

U.S. PATENT DOCUMENTS

| | | | | |
|---|---|---|---|---|
| 3,570,408 A | | 3/1971 | Lich | |
| 5,615,786 A | * | 4/1997 | Hoyon | B61D 3/10 105/3 |
| 6,601,520 B2 | | 8/2003 | Eche et al. | |
| 8,011,305 B2 | * | 9/2011 | Al-Kaabi | B61D 3/10 105/3 |
| 8,794,160 B2 | * | 8/2014 | Nishimura | B61D 13/00 105/158.2 |

FOREIGN PATENT DOCUMENTS

| | | |
|---|---|---|
| DE | 295 12 446 U1 | 10/1995 |
| EP | 0 831 003 A2 | 3/1998 |
| EP | 1 270 359 A1 | 1/2003 |
| EP | 1 312 526 A | 5/2003 |

OTHER PUBLICATIONS

FR Search Report, dated Jul. 11, 2016, from corresponding FR application.

* cited by examiner

*Primary Examiner* — Robert J McCarry, Jr.
(74) *Attorney, Agent, or Firm* — Young & Thompson

(57) ABSTRACT

The railway vehicle includes two adjacent carriages (6), each including a carriage body (8), the bodies (8) being supported by a common bogie (1) and being articulated with each other with an articulation device (2). The articulation device (2) is received in a space (30) of the bogie (1), the space (30) being delimited along a longitudinal direction by a first abutment surface and by a second abutment surface (34), the articulation device (2) extending facing the first and second abutment surfaces (34) so that, when the railway vehicle moves in a first longitudinal direction, the first abutment surface comes into contact with the articulation device (2), and, when the railway vehicle moves in a second longitudinal direction, the second abutment surface (34) comes into contact with the articulation device (2).

9 Claims, 6 Drawing Sheets

BOGIE FOR FULL DOUBLE DECK EMU

FIELD OF THE INVENTION

The present invention relates to a railway vehicle of the type comprising at least two adjacent carriages, each comprising a carriage body, said bodies being supported by a common bogie and being articulated with each other by an articulation device attached to both bodies so as to form an articulated connection between both bodies.

BACKGROUND OF THE INVENTION

The invention more particularly applies to railway vehicles with two stories intended for trips between several cities, of the high speed train type, inter-region trains and others.

In this type of railway vehicles, the interconnection between the successive carriages is generally accomplished on a single level, i.e. the passengers have to climb to the upper level or walk down to the lower level for passing from one carriage to the following, which complicates circulation in the railway vehicle and poses a problem for persons with reduced mobility.

For example in document EP-1 312 526, railway vehicles were proposed in which the passing between two successive carriages is accomplished on both levels. However, in this document, the interconnection passes between two wheels directly connected to the body of the railway vehicle and not at upright angles to a bogie supporting the ends of two successive bodies and allowing driving of the railway vehicle. In this document, when such a bogie is provided, for the end carriages, the flooring is raised so as to pass above the bogie, the vehicle only comprising a single level upright to the bogie.

The interconnection described in document EP-1 312 526 is therefore not satisfactory for railway vehicles moving at high speed in which the ends of both successive carriages are supported by a bogie. Furthermore, the railway vehicle is not optimized in terms of capacity for receiving travelers. One of the objects of the invention is to overcome these drawbacks by proposing a railway vehicle for which two successive carriages are supported by a common bogie while allowing interconnection with two levels without raising the flooring.

SUMMARY OF THE INVENTION

To this end, the invention relates to a railway vehicle of the aforementioned type, wherein the articulation device is received in a space of the bogie, said space being delimited along a longitudinal direction by a first abutment surface and by a second abutment surface extending on either side of said space, the articulation device extending facing said first and second abutment surfaces so that when the railway vehicle circulates in a first longitudinal direction, the first abutment surface comes into contact with the articulation device so that the displacement of the bogie causes displacement of the bodies in the first direction via the articulation device, and when the railway vehicle circulates in a second longitudinal direction opposite to the first direction, the second abutment surface comes into contact with the articulation device so that the displacement of the bogie causes displacement of the bodies in the second longitudinal direction via the articulation device.

The bogie of the railway vehicle according to the invention supports the ends of two adjacent carriages and is able to drive these carriages when the train is circulating by means of the contact between the articulation device and the abutment surfaces. Further, the space provided in the bogie for receiving the articulation device allows an interconnection on two levels to pass upright to the bogie without requiring the flooring to be raised upright to the bogie. Thus, the circulation in the railway vehicle may be accomplished without changing level and without crossing steps. Further, the railway vehicle may be optimized in terms of the capacity of receiving travelers.

According to other features of the railway vehicle according to the invention, taken individually or according to all the technically possible combinations:

- the articulation device comprises a first articulation element attached to one of the bodies and a second articulation element attached to the other body, said first and second articulation elements being connected to each other so as to form an articulation connection between both bodies, the first articulation element extending facing the first abutment surface and the second articulation element extending facing the second abutment surface;
- the bogie comprises a chassis resting on four wheels, a pair of wheels extending on each side of the chassis, said chassis supporting at least one motor positioned on one side of the chassis and connected to at least one wheel through transmission means, each wheel including an individual wheel shaft;
- the bogie comprises two motors each positioned on one of the sides of the chassis on either side of the space along a transverse direction substantially perpendicular to the longitudinal direction, each motor being connected to two of the wheels of the bogie by transmission means;
- the bogie comprises four braking clamps, each braking clamp being positioned around a portion of at least one of the wheels of the bogie in order to allow braking of the bogie when said clamps are actuated, the clamps extending pair wise one facing the other along the longitudinal direction so that each clamp extends between the wheels of one of the pairs of wheels, each clamp being positioned on the inner side of the wheel around which said clamp is positioned;
- said chassis of the bogie comprises two longitudinal members positioned on the outside of the wheels and connected together through crossed pieces having a lowered central portion extending below the plane defined by the axis of the wheels;
- each carriage comprises a lower flooring and an upper flooring, positioned one above the other so as to define a lower level and an upper level;
- the carriages are connected to each other through an interconnection passage, said passage substantially extending upright to the articulation device and comprising a lower flooring connecting the lower floorings of both carriages and an upper flooring connecting the upper floorings of both carriages;
- the lower floorings of the carriages and of the interconnection passage substantially extend at the same height and the upper floorings of the carriages and of the interconnection passage substantially extend at the same height, greater than the height of the lower floorings;
- the plane of the lower floorings coincides with a plane crossing the bogie.

BRIEF DESCRIPTION OF THE DRAWINGS

Other aspects and advantages of the invention will become apparent upon reading the description which follows, given as an example and made with reference to the appended drawings, wherein.

DETAILED DESCRIPTION OF THE INVENTION

Figure 1:
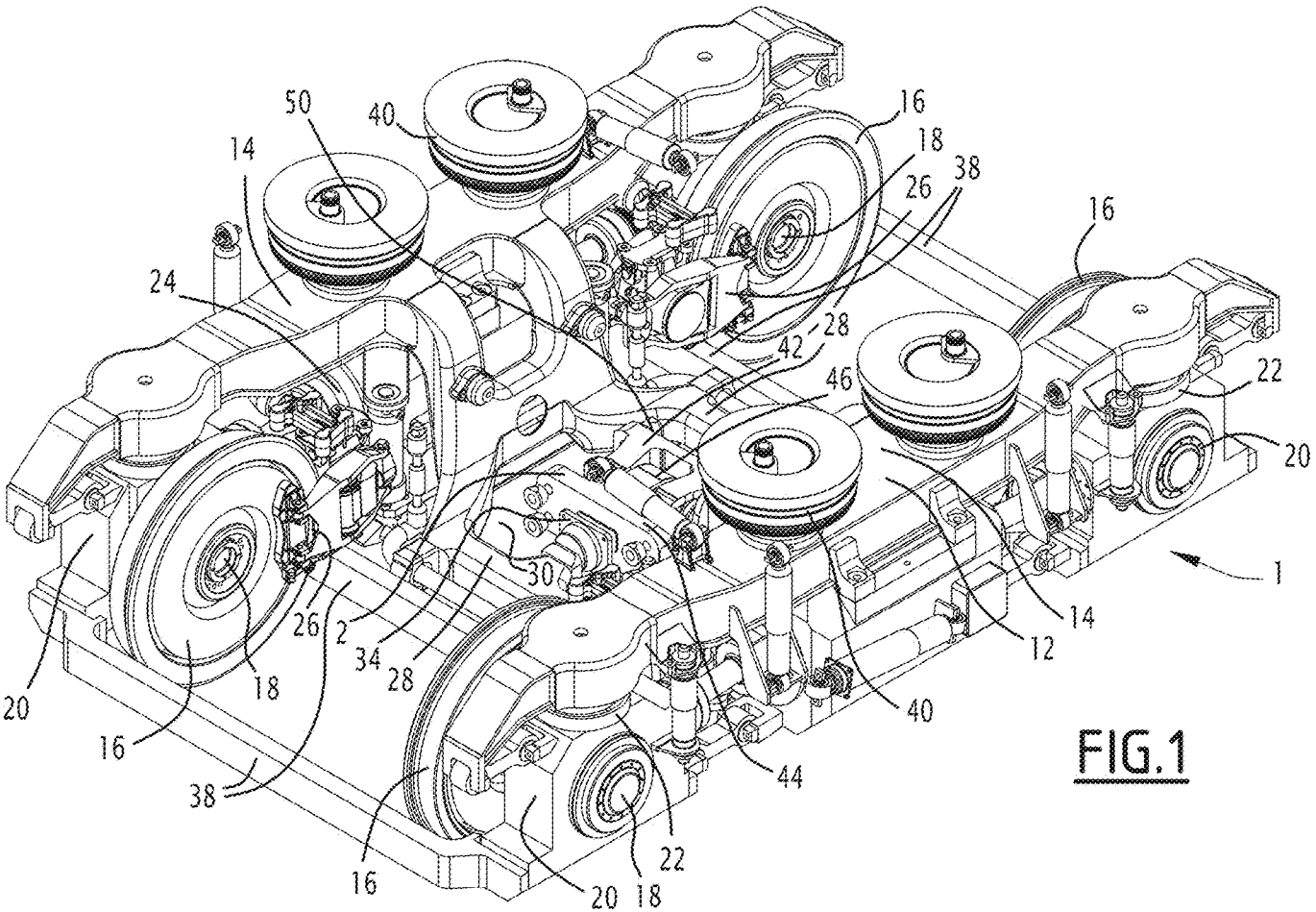
FIG. 1 is a schematic perspective illustration of a bogie and of an articulation device of a railway vehicle according to the invention.

In the description, the terms of «over», «under», «above», «below» are defined with respect to an elevational direction of a railway vehicle when it is positioned on rails, i.e. a substantially vertical direction when the train circulates. The longitudinal direction is defined by the circulation direction of the railway vehicle and the transverse direction is the direction substantially perpendicular to the longitudinal direction and the elevational direction of the railway vehicle.

With reference to FIGS. 1 to 4, a bogie 1 and an articulation device 2 of a railway vehicle 4 are described, comprising at least two adjacent carriages 6 with view to forming a railway vehicle with two levels, the interconnection of which allows circulation on both levels, as this will be described subsequently.

The bogie 1 extends under and between two adjacent carriages 6 and is laid out for supporting the bodies 8 of these carriages. More particularly, the bogie 1 is laid out for supporting the ends 10, facing each other, of the bodies 8 of the adjacent carriages 6.

According to the exemplary embodiment illustrated in FIG. 1, the bogie 1 comprises a chassis 12 comprising two longitudinal members 14 substantially extending along the longitudinal direction of circulation of the railway vehicle and spaced apart from each other along the transverse direction substantially perpendicular to the longitudinal direction and to the elevational direction of the railway vehicle.

Two wheels 16 are mounted on each member 14, at each of the longitudinal end portions of the latter, so that a pair of wheels 16 extends on each side of the chassis 12. More particularly, each wheel 16 comprises an individual shaft 18 rotatably mounted around a transverse axis on an axle body 20. By individual shaft, is meant that each wheel 16 is movable in rotation with respect to the chassis independently of the others, unlike a traditional bogie in which an axle generally connects the wheels pair wise and simultaneously drives both wheels into rotation. Each extreme portion of a longitudinal member 14 lies on an axle body 20 via a primary suspension 22 allowing vertical displacement of the chassis 1 with respect to the wheels 16. The wheels are mounted so as to extend, along the transverse direction, inside the gauging device defined by the contour of the chassis 12, the axle bodies 20 being positioned on the outer side of the wheels 16.

In the case of a motor-driven bogie 1, each member 14 further bears at least one motor 24 laid out for driving into rotation both wheels 16 borne by the member. The motor is thus connected to an axle body 20 of each wheel 16 by the transmission means. These transmission means are for example of the same type as those described in document EP-1 270 359 and will not be described in more detail here. Each motor 24 is borne by its member 14 between both wheels 16 borne by said member 14.

The bogie 1 further comprises a braking device comprising four brake clamps 26, each positioned, around a portion of one of the wheels 16 so as to brake the wheels 16 in a known way when the braking device is actuated. The brake clamps 26 are each positioned on the inner side of the wheels 16 along the longitudinal direction, i.e. they extend towards the centre of the bogie 1 along the longitudinal direction and not outwards, as this is customarily the case. Thus, the brake clamps 26 extend pair wise facing each other along the circulation direction so that each clamp 16 extends between the wheels of one of the pairs of wheels along the longitudinal direction.

The side members 14 are connected to each other by at least one crosspiece 28 extending along the transverse direction between both members 14. According to the embodiment illustrated in the figures, the members 14 are connected through two crosspieces 28 spaced apart from each other along the longitudinal direction. The crosspieces 28 comprise at least one central portion extending in a plane lowered between the longitudinal members, i.e. in a plane extending under the plane defined by the axes of the wheels 16.

A space 30 is delimited, in the plane of the crosspieces 28, by both crosspieces 28 along the longitudinal direction and by the longitudinal members 14 along the transverse direction. The space 30 for example extends between both motors 24 along the transverse direction.

The bogie 1 further comprises a first abutment surface 32 and a second abutment surface 34 extending in the space 30, on either side of the latter along the longitudinal direction. The abutment surfaces 32 and 34 thus extend facing each other on either side of the space 30 along the longitudinal direction, for example substantially at the centre of the bogie 1 along the transverse direction. The first and second abutment surfaces 32 and 34 are for example each borne by one of the crosspieces 28 delimiting the space 30, as this is more particularly visible in FIG. 4. The first and second abutment surfaces 32 and 34 are for example formed by shoes each extending in a plane defined by the transverse direction and by the elevational direction. According to the embodiment illustrated in the figures, an absorption element, for example in rubber, 36 is positioned between each abutment surface 32, 34 and the crosspiece 28 which bears this abutment surface 32, 34.

According to the embodiment illustrated in the figures, the bogie 1 further comprises secondary crosspieces 38 connecting together the axle bodies 20, these secondary crosspieces 38 being positioned on either side of each wheel 16, at a height substantially identical with that of the crosspieces 28, i.e. a height lowered under the plane defined by the shafts 18 of the wheels 16. These secondary crosspieces 38 ensure the maintaining of the distance and of the parallelism between the wheels 16.

Figure 2:
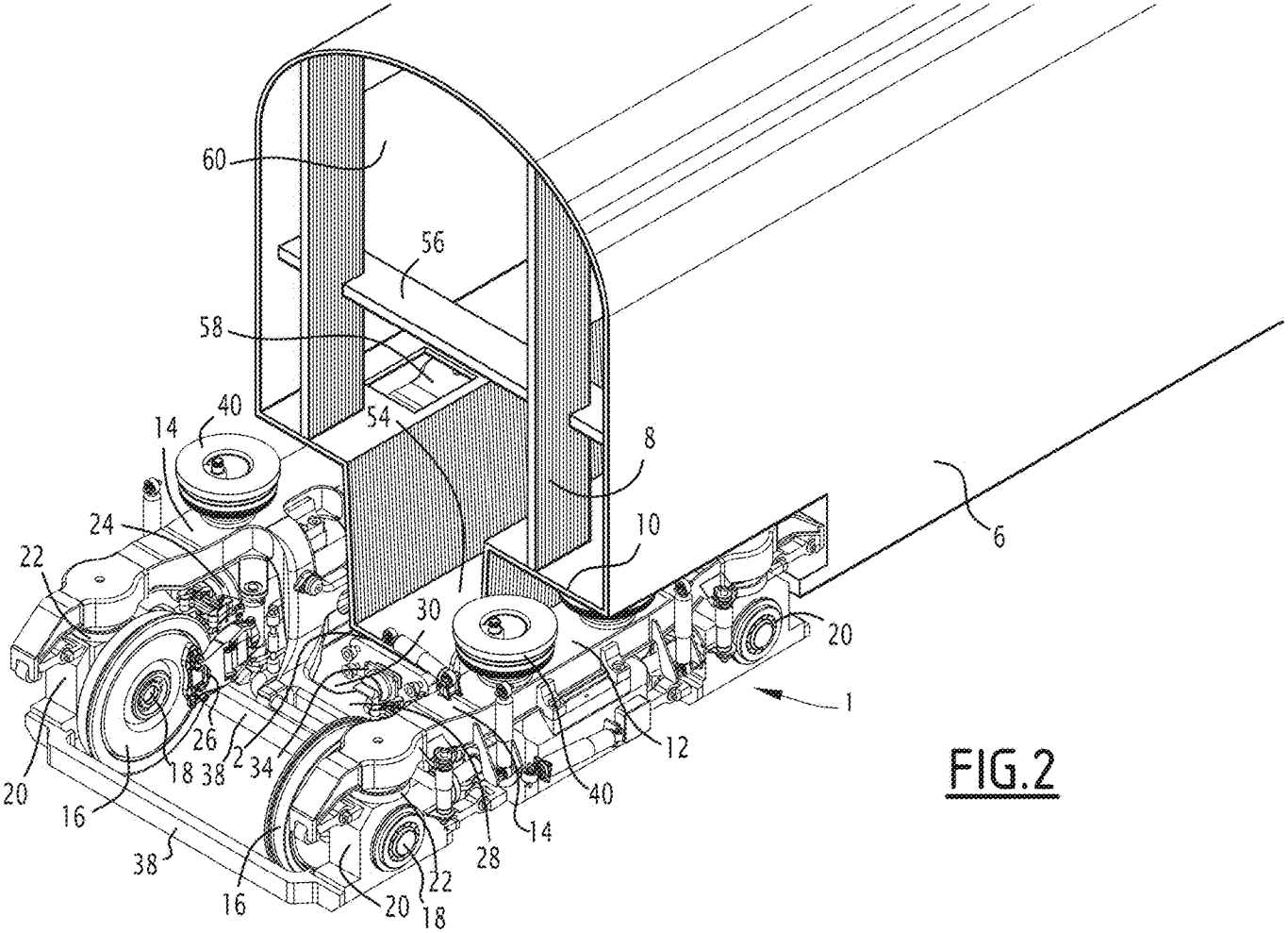
FIG. 2 is a schematic perspective illustration of the bogie of FIG. 1 supporting a carriage bogie of a railway vehicle according to the invention.
Figure 3:
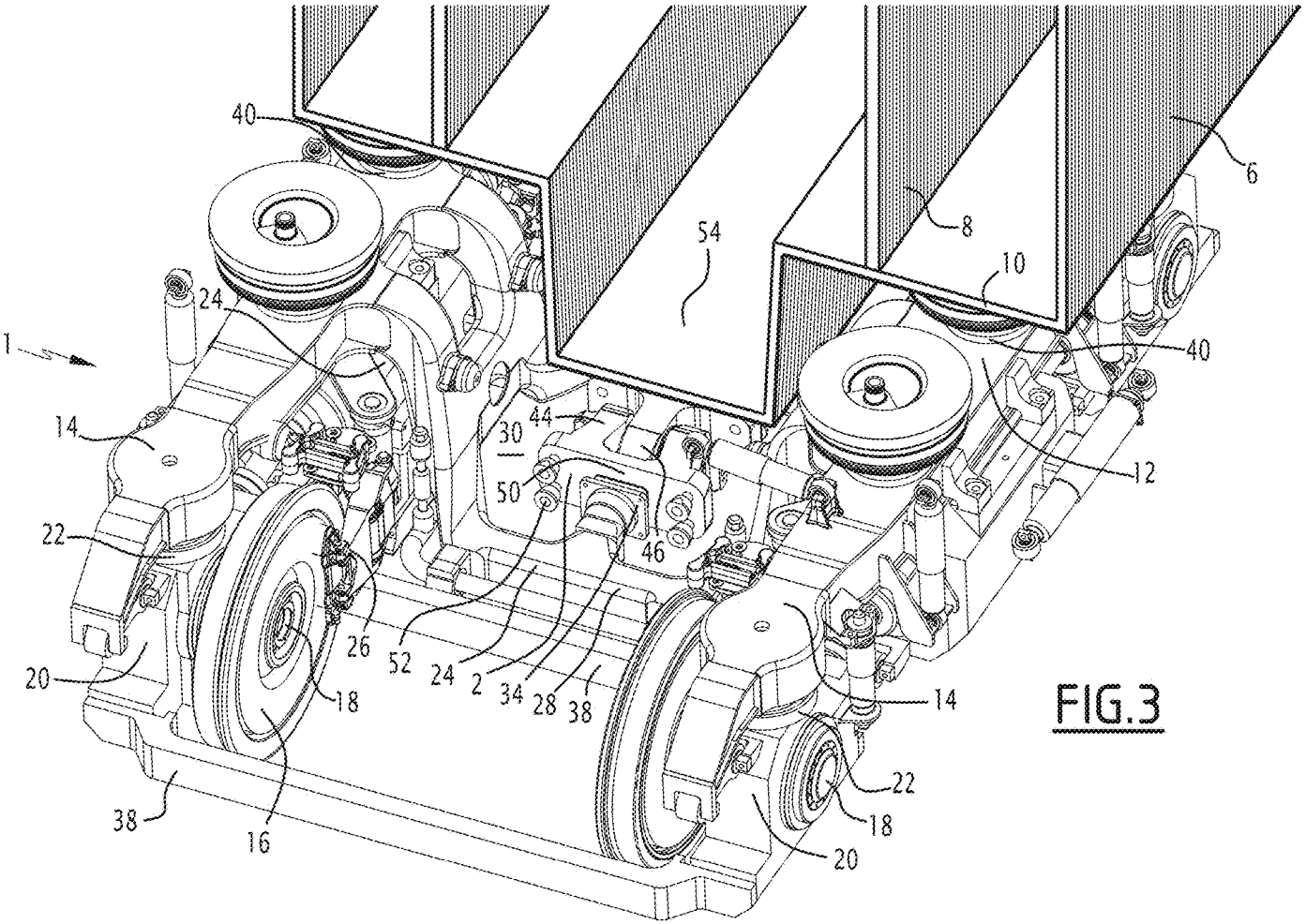
FIG. 3 is an enlarged view of a portion of FIG. 2.

The bogie above gives the possibility of having a significant available volume between the longitudinal members 14 above the crosspieces 28, as this is visible in FIGS. 1 to 3. Indeed, the bogie 1 does not comprise any elements positioned between both members 14 above the plane defined by the crosspieces 28. This volume will allow passage of a lowered interconnection flooring, as this will be described subsequently. It is understood that another bogie structure may be contemplated, outside the space 30 and the abutment surfaces 32 and 34, as long as a space is left clear for passage of the interconnection. As an example, the bogie may be a driven bogie, i.e. without any motor, or all the wheels of the bogie are not necessarily driven into rotation by a motor.

The ends 10 facing the bodies 8 of both adjacent carriages 6 are received by secondary suspensions 40 provided on the longitudinal members 14, allowing vertical displacement of the bodies 8 with respect to the bogie 1.

Both bodies 8 are articulation with each other by the articulation device 2 attached to both bodies so as to form an articulated connection between both bodies giving the possibility of absorbing the displacements between both bodies 8. More particularly, the articulation device 2 for example comprises a first articulation element 42 attached to the end 10 of one of the bodies 8, and a second articulation element 44 attached to the end 10 of the other body 8, the first and second articulation elements 42 and 44 being connected to each other so as to form an articulation connection between both bodies. The connection between both articulation elements 42 and 44 for example forms a ball-joint connection 46 allowing displacement in all directions between the bodies.

Figure 4:
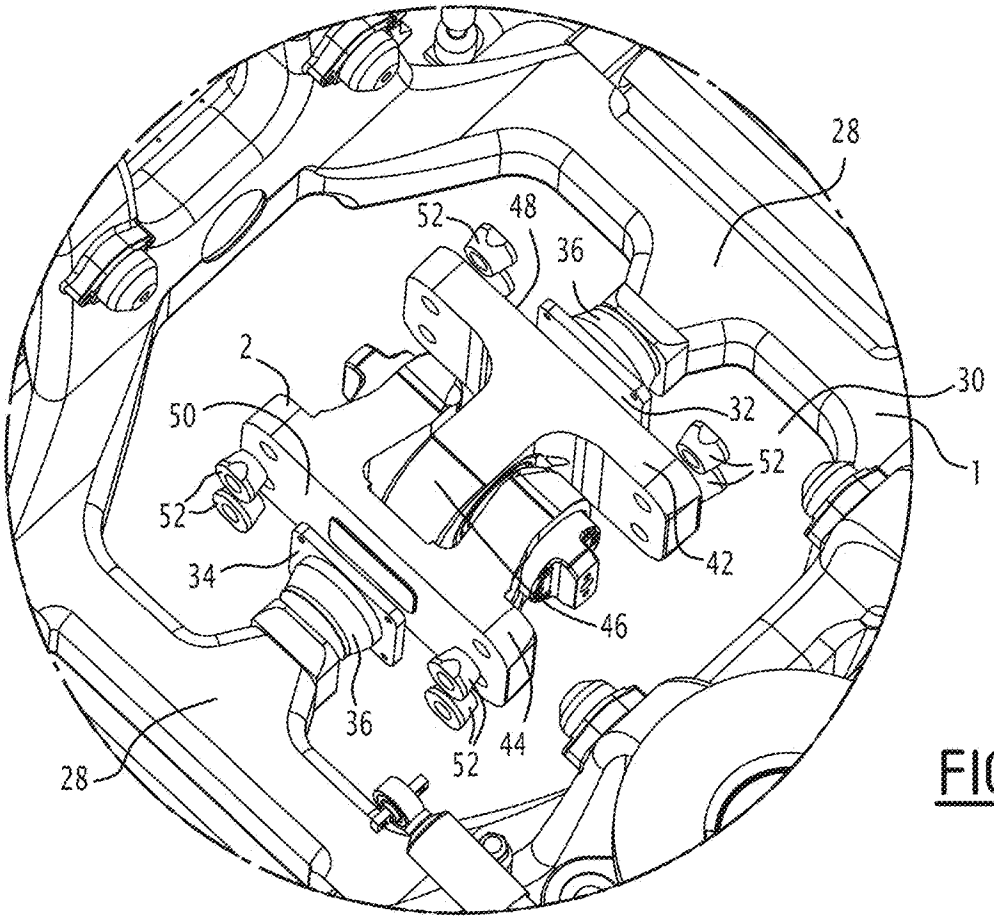
FIG. 4 is a schematic perspective illustration of the articulation device and of the abutment surfaces of FIG. 1.

The articulation elements 42 and 44 are attached to the bodies 8 so that the articulation device 2 extends into the space 30 between the abutment surfaces 32 and 34, as this is most particularly visible in FIG. 4. The articulation device 2 and the space 30 are dimensioned so that a displacement exists along the longitudinal direction. In other words, the distance separating the first abutment surface 32 from the second abutment surface 34 along the longitudinal direction is greater than the dimension of the articulation device 2 along the longitudinal direction.

The first articulation element 42 comprises a counter-abutment surface 48 extending facing the first abutment surface 32 and the second articulation element 44 comprises a counter-abutment surface 50 extending facing the second abutment surface 34. The counter-abutment surfaces further bear means 52 for attachment to the body 8.

Thus, when the railway vehicle is mounted and when it circulates along a first longitudinal direction of circulation ranging from the first abutment surface 32 to the second abutment surface 34, the bogie 1 moves until the first abutment surface 32 comes into contact with the counter-abutment surface 48 of the first articulation element 42, so that the bogie 1 causes displacement of the carriages 6 via the articulation device 2 along this first longitudinal direction. Similarly, when the railway vehicle moves along a second longitudinal circulation direction, opposite to the first longitudinal direction, ranging from the second abutment surface 34 to the first abutment surface, the bogie 1 moves until the second abutment surface 34 comes into contact with the counter-abutment surface 50 of the second articulation element 44, so that the bogie 1 drives the displacement of the carriages 6 via the articulation device 2 along this second longitudinal direction.

As the articulation device extends into the space 30, this articulation device does not occupy either the free space between the longitudinal members 14 above the crosspieces 28. Thus, this volume is left clear for the passing of a low interconnection flooring, as this will be described now.

Figure 5:
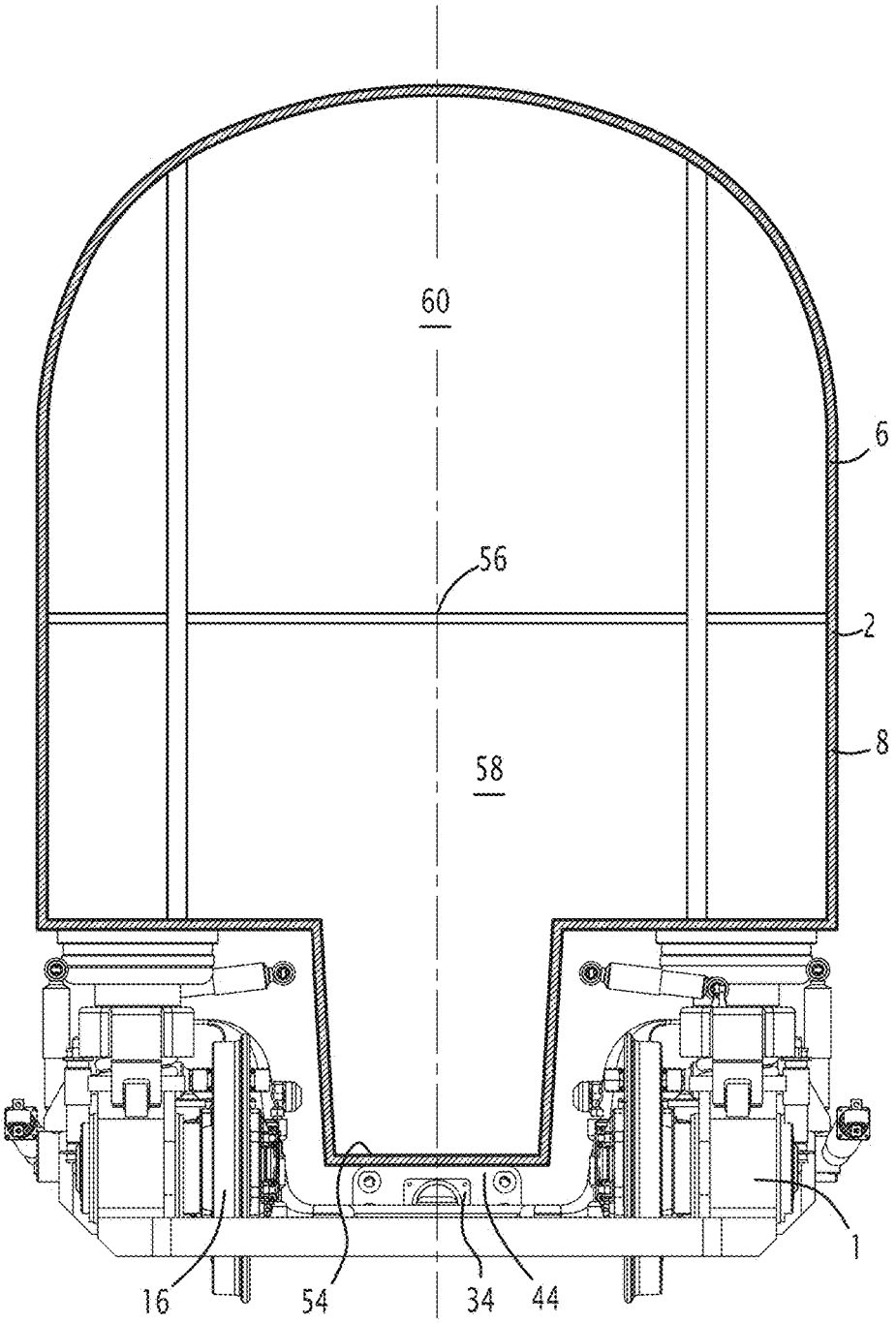
FIG. 5 is a schematic sectional illustration of the interconnection provided between two adjacent carriages of the railway vehicle according to the invention.

Each carriage 6 is a carriage with two levels, as this is illustrated in FIG. 5. Thus, each carriage 6 comprises a lower flooring 54 and an upper flooring 56, positioned above each other so as to define a lower level 58 and an upper level 60. The lower flooring 54 and the upper flooring 56 are for example substantially planar and horizontal so that the carriages may be crossed without any difficulty. Further, the lower 54 and upper 56 floorings of a carriage extend at the same level as the lower 54 and upper 56 floorings of the other level, i.e. the lower 54 and upper 56 floorings of all the carriages extend at the same height, the height of the upper floorings 56 being greater than that of the lower floorings 54. As an example, the lower flooring 54 extends at a height substantially comprised between 530 and 550 mm and the upper flooring 56 extends at a height substantially comprised between 2,380 and 2,400 mm. The heights given above depend on the gauging device in which the vehicle has to be included.

The carriages 6 are connected to each other through an interconnection passage 62 substantially extending upright to the articulation device 2 and allowing the passing from one carriage to the other to the users of the railway vehicle. For this purpose, the interconnection passage 62 comprises a lower flooring, connecting the lower floorings 54 of the carriage 6 and extending at the same height as these floorings, and an upper flooring, connecting the upper floorings 56 of the carriage 6 and extending at the same height as these floorings. Thus, the users of the railway vehicle do not need to change level for passing from one carriage to the other, as this is usually the case in railway vehicles with two stories. Further, the passing from one carriage to the other through the lower level may be accomplished without crossing any step or ramp since the lower floorings all extend at the same height. The circulation in the railway vehicle is thus facilitated, in particular for persons with reduced mobility.

The arrangement of the lower flooring of the interconnection passage 62 to the same height as that of the lower floorings 54 of the carriages is made possible by the layout of the bogie 1, which has a significant free space between the longitudinal members 14. Thus, the lower flooring of the interconnection passage 62 may extend in a plane coinciding with one of the planes of the bogie 1 and more particularly with a plane near the plane defined by the crosspieces 28, as illustrated in FIG. 4.

The railway vehicle described above may be applied, as illustrated in FIGS. 6 and 7, with more than two carriages 6 and with an optimized capacity for receiving travelers.

Figure 6:
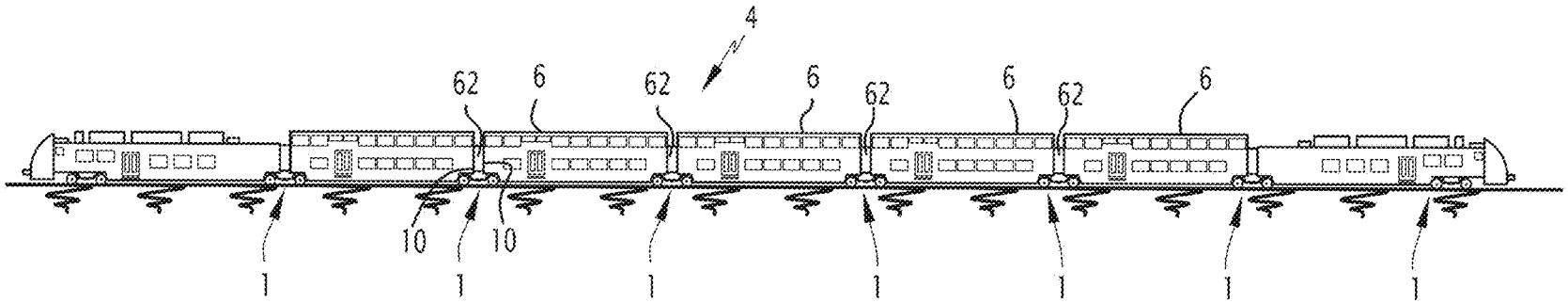
FIG. 6 is a schematic side illustration of a railway vehicle according to the invention.
Figure 7:
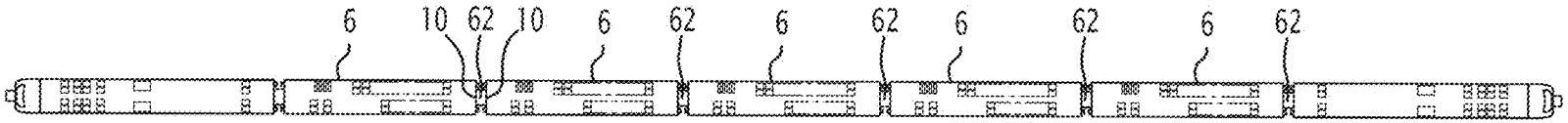
FIG. 7 is a schematic sectional illustration of the railway vehicle of FIG. 6.

According to the embodiment illustrated in FIGS. 6 and 7, the railway vehicle thus comprises five carriages 6 with two levels and two end carriages 64, each comprising one level and a driving station. The carriages with two levels 6 are connected to each other through an interconnection passage 62 as described above. Such a railway vehicle is able to receive 600 passengers. Further, the bogie is adapted for trains moving at high speeds ranging up to 200 km/h, or even beyond, while having a structure giving the possibility of receiving a lowered lower flooring, as described earlier.

It is understood that the structure of the articulation device 2 may be different from the one described above, as long as this articulation device is able to come into contact with the abutment surfaces of the bogie 1 so that the bogie causes displacement of the carriages of the vehicle.

The invention claimed is:

1. A railway vehicle comprising:

at least two adjacent carriages, each carriage comprising a carriage body, said bodies being supported by a common bogie and being articulated with each other by an articulation device attached to both bodies to form an articulation connection between both bodies, wherein the articulation device is received in a space of the bogie, said space being delimited along a longitudinal direction by a first abutment surface and by a second abutment surface extending on either side of said space, the articulation device extending facing said first and second abutment surfaces so that, when the railway vehicle moves in a first longitudinal direction, the first abutment surface comes into contact with the articulation device so that the displacement of the bogie causes displacement of the bodies in the first direction via the articulation device, and, when the railway vehicle moves in a second longitudinal direction opposite to the first direction, the second abutment surface comes into contact with the articulation device so that the displacement of the bogie causes displacement of the bodies in the second longitudinal direction via the articulation device, the articulation device comprising a first articulation element attached to one of the bodies and a second articulation element attached to the other body, said first and second articulation elements being connected to each other to form the articulation connection between both bodies, the first articulation element extending facing the first abutment surface and the second articulation element extending facing the second abutment surface.

2. The railway vehicle according to claim 1, wherein the bogie comprises a chassis lying on four wheels, a pair of wheels extending on each side of the chassis, said chassis supporting at least one motor positioned on one side of the chassis and connected to at least one wheel by a transmission system, each wheel including an individual wheel shaft.

3. The railway vehicle according to claim 2, wherein the bogie comprises two motors each positioned on one of the sides of the chassis on either side of the space along a transverse direction substantially perpendicular to the longitudinal direction, each motor being connected to two of wheels of the bogie by the transmission system.

4. The railway vehicle according to claim 2, wherein the bogie comprises four braking clamps, each braking clamp being positioned around a portion of one of the wheels of the bogie so as to allow braking of the bogie when said clamps are actuated, the clamps extending pair wise facing each other along the longitudinal direction so that each clamp extends between the wheels of one of the pairs of wheels, each clamp being positioned on the inner side of the wheel around which said clamp is positioned.

5. The railway vehicle according to claim 2, wherein said chassis of the bogie comprises two longitudinal members positioned on the outside of the wheels and connected together through crosspieces having a central lowered portion extending below the plane defined by the axis of the wheels.

6. The railway vehicle according to claim 1, wherein each carriage comprises a lower flooring and an upper flooring, positioned above each other so as to define a low level and an upper level.

7. The railway vehicle according to claim 6, wherein the carriages are connected to each other through an interconnection passage, said passage substantially extending upright to the articulation device and comprising a low flooring connecting the low floorings of both carriages and an upper flooring connecting the upper floorings of both carriages.

8. The railway vehicle according to claim 7, wherein the low floorings of the carriages and of the interconnection passage extend substantially at the same height and the upper floorings of the carriages and of the interconnection passage substantially extend at the same height, greater than the height of the low floorings.

9. The railway vehicle according to claim 8, wherein the plane of the lower floorings coincides with a plane crossing the bogie.

* * * * *